United States Patent [19]

Schuda et al.

[11] Patent Number: 4,724,352

[45] Date of Patent: Feb. 9, 1988

[54] SHORT-ARC LAMP WITH ALTERNATING CURRENT DRIVE

[75] Inventors: Felix Schuda, Cupertino; Roy D. Roberts, Newark, both of Calif.

[73] Assignee: ILC Technology, Inc., Sunnyvale, Calif.

[21] Appl. No.: 809,296

[22] Filed: Dec. 16, 1985

[51] Int. Cl.[4] ..... H01J 17/16; H01J 61/30

[52] U.S. Cl. ..... 313/246; 313/110; 313/113; 313/570; 313/621; 313/620; 313/567; 313/568; 313/631; 313/632; 313/243; 313/244

[58] Field of Search ..... 313/326, 113, 570, 634, 313/632, 336, 246, 244, 252, 568, 620, 621, 631

[56] References Cited

U.S. PATENT DOCUMENTS

| | | | |
|---|---|---|---|
| 2,703,374 | 3/1955 | Fruengel | 313/113 X |
| 2,974,249 | 3/1961 | Thouret | 313/113 |
| 3,280,360 | 10/1966 | Frost et al. | 313/113 |
| 3,378,713 | 4/1968 | Ludwig | 313/113 |
| 3,497,742 | 2/1970 | Richter | 313/113 |

FOREIGN PATENT DOCUMENTS

| | | | |
|---|---|---|---|
| 2435177 | 2/1975 | Fed. Rep. of Germany | 313/631 |
| 0012250 | 1/1983 | Japan | 313/113 |

OTHER PUBLICATIONS

Koch, "The Ellipsoidal Reflector," *The Electronic Engineer*, Jul. 1967, pp. 56–60.

*Primary Examiner*—David K. Moore
*Assistant Examiner*—Michael J. Nickerson
*Attorney, Agent, or Firm*—Thomas E. Schatzel

[57] ABSTRACT

A short-arc lamp of the type having an internally integral reflector including electrodes mounted to extend along a central axis of symmetry of the lamp and having distal ends of similar shape which are spaced apart to define a short-arc gap such that the lamp can be directly driven by alternating current.

1 Claim, 2 Drawing Figures

SHORT-ARC LAMP WITH ALTERNATING CURRENT DRIVE

BACKGROUND OF THE INVENTION

1. Field of the Invention

The present invention relates generally to arc lamps, and more particularly, to arc lamps of the type which have short-arc gaps and integral, internal reflectors.

2. Description of the Prior Art

It is well known to utilize lamps having short-arc gaps to provide compact yet intense point sources of light. Such lamps are utilized for example, in medical and industrial endoscopes. Generally speaking, such lamps include a sealed chamber which contains a gas pressurized to several atmospheres, an anode and cathode mounted along the central axis of the concave chamber to define an arc gap, an integral concave reflector which serves to collimate light generated at the arc gap, and a window at the mouth of the chamber to permit external transmission of the collimated light from the lamp. In such prior art devices, current to the electrodes was direct current and, accordingly, electrons were emitted only from the cathode and collected only on the anode. To optimize the flow of DC current to create optical discharge, such anodes and cathodes at the arc gaps are shaped such that the tip of the cathode is pointed and the tip of the anode is relatively broader and blunted.

When utilizing direct current to power such prior short-arc lamps with integral internal reflectors, it is known to operate the lamps in a pulsed manner. During non-pulsed operation, a small current (known as the simmer current) is provided to the lamp, until such time as the lamp is pulsed; then the current is increased substantially (e.g. to about one-hundred amperes). In one known mode of operation, for example, the pulses are generated about one every 1.5 seconds and each pulse has a duration of about 100 milliseconds (i.e., one-tenth second), resulting in an energy flow across the short-arc gap of several hundred joules for the duration of the pulse. Typical voltages required for starting such lamps are approximately 12,000 volts.

One problem with short-arc lamps with internal reflectors and direct current drive, is that the anode and cathode electrodes physically deteriorate over time. Such deterioration can be caused by the high current inflow when starting the lamps or during pulsing. The deterioration normally manifests itself by sputtering of the tungsten material which forms the electrodes. One result of such deterioration is that the voltages required to start the lamp increase substantially. When the starting voltage becomes exceptionally high, the lamps must be replaced. In practice, such lamps are usually driven from an alternating current source via a rectifier which operates upon the alternating current to provide essentially direct current to the electrodes of the lamp.

It is also known in the art to utilize short-arc lamps which do not have integral internal reflectors. Such lamps are typically filled with xenon at pressures of several atmospheres. When the lamp is operated, gas pressure within the lamp may triple from the pressure when the lamp was cold. It is known to directly operate such lamps with alternating current fed to the lamp via a ballast and a current limiting device such as a choke coil or leakage transformer.

SUMMARY OF THE INVENTION

A primary object of the present invention is to provide a short-arc lamp of the type having an internally integral reflector, the electrodes of which lamp are directly driven by alternating current.

In accordance with the preceding objects, the present invention provides a lamp of the short-arc type having a body formed of a dielectric material; a concave reflector fitted within the body to define a curved reflecting wall symmetrical about a central axis of the lamp; a transparent window assembly sealingly mounted to the body transverse to the central axis to maintain pressurized gas within the space encompassed by the curved reflector and to pass collimated light from the lamp; first and second opposed electrodes mounted to extend along said central axis with their distal ends being substantially identical in shape and located to define a short arc gap at the focal point of the concave reflector; and means connected to convey alternating electric current to the electrodes to thereby provide an alternating luminescent flow of electrons between the tips of the first and second electrodes.

Accordingly, a primary advantage of the present invention is the provision of a short-arc lamp of the type having an integral internal reflector, the electrodes of which lamp are directly driven by alternating current and, hence, whose power supply components are simplified and reduced in number.

These and other objects and advantages of the present invention will no doubt become obvious to those of ordinary skill in the art after having read the following detailed description of the preferred embodiment which is illustrated in the various drawing figures.

IN THE DRAWINGS

FIG. 1 is a side view, in axial section, of a lamp system according to the present invention; and FIG. 2 is an end view of the lamp of FIG. 1 taken along the line 2—2 for viewing in the direction of the arrows.

DETAILED DESCRIPTION OF THE PREFERRED EMBODIMENT

Figure 1:
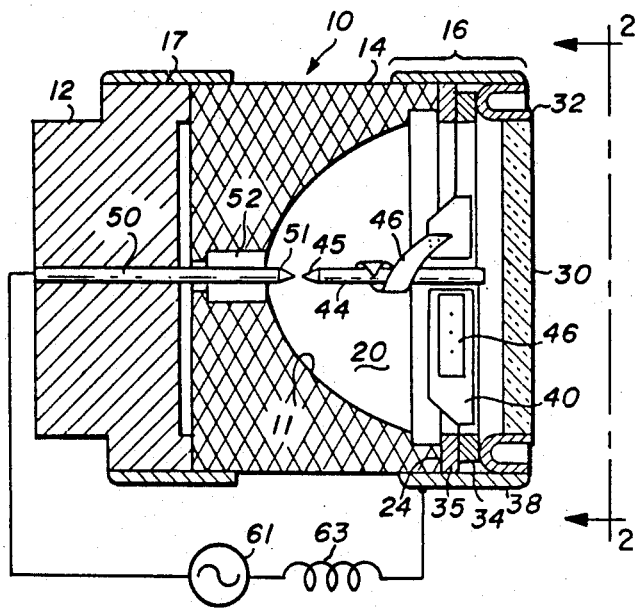
Figure 2:
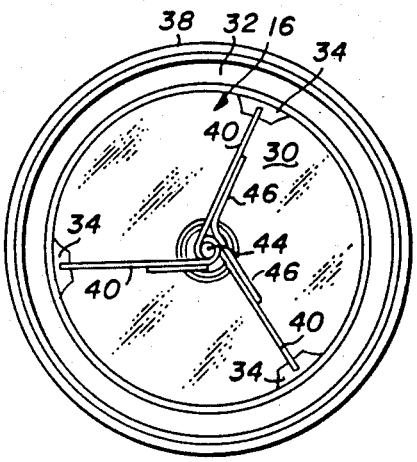

FIGS. 1 and 2 illustrate a short-arc lamp, generally designated by the reference character 10, of the type having an integral internal reflector 11. The lamp 10 includes a metallic base member 12, a body section 14 formed of a dielectric material which defines the reflector 11, and a window assembly generally designated by the reference character 16. The base 12, the body section 14, and the window assembly 16 are all generally circular in transverse cross-section, and are generally symmetrical about the longitudinal central axis of the lamp 10, as can be seen in FIG. 2. The base 12 is secured to the body 14 by a cylindrical metallic band 17 which overlappingly surrounds both the body and the base. The base 12 functions both as a heat sink for the lamp and as an electrical conductor to carry current to the lamp. In practice, the base 12 is often formed of iron, which material is chosen for its electrical and thermal conductivity characteristics.

The body 14 of the lamp 10 of FIGS. 1 and 2 includes a hollow concave cavity 20 which defines the reflector 11. Like the other components of the lamp 10, the reflector 11 is symmetrical about the longitudinal central axis of the lamp 10. In practice, the reflector 11 may be parabolic, elliptical or aspherical in shape to provide a particularly desired collimation of light. Typically the reflector 11 has a reflective metal coating deposited thereon. The reflector 11 can be formed as part of the body 14 or can be a separate piece which, nevertheless, is internally integral to the lamp 10.

The window assembly 16 is sealingly secured across the mouth 24 of the cavity 20 traverse to the central axis of the lamp 19. The window assembly 16 serves to pass collimated, high intensity light from the lamp 10. In the illustrated embodiment, window assembly 16 includes a transparent circular window 30 formed, for example, of a sapphire disk. The outer periphery of circular window 30 is sealing surrounded by a flange member 32 which is U-shaped in radial cross-section (FIG. 1) and which has an inside diameter which snugly receives the circular window 30. In the assembled condition of the lamp 10, a metallic spacer ring 34 and a ceramic ring 35 are interposed between the U-shaped flange 32 and mouth 24 of the concave cavity 20, and a cylindrical metal band 38 overlappingly surrounds the U-shaped flange 32 and the body 14 to secure the window assembly to the body. As so constructed and assembled, the interior of the cavity 20 is hermetically sealed.

The window assembly 16 of FIGS. 1 and 2 further includes three support struts 40 which, at their radially outward ends, are secured to the spacer ring 34 and positioned to extend radially inward therefrom across the face of the window 30 toward the axial centerline of the lamp 10. The struts 40 are electrically conductive and are fixed, as by brazing, to the spacer ring 34. At their radially inward ends, the struts 40 support a rod-shaped first electrode 44 which, in turn, extends along the axial centerline of the lamp 10 toward the focal point of the reflector 11. Preferably, the first electrode 44 is circular in cross-section and, its distal end, tapers to a tip 45 adjacent the focal point of the cavity 20.

As further shown in FIGS. 1 and 2, strips of metal 46, called "getters", can be secured to the struts 40 and the first electrode 44. The getters 46 are typically fabricated of zirconium and are provided to absorb impurities formed within the cavity 20 during operation of the lamp 10. Such impurities may be generated, for example, by outgassing of materials forming the body 14 when the interior of the lamp reaches high temperatures.

The lamp 10 of FIGS. 1 and 2 further include a second electrode member 50 which extends along the central axis of the lamp from the base 12 to a location adjacent the focal point of the reflector 11. Similar to the first electrode 44, the second electrode 50 is circular in cross-section and tapers to a distal tip 51. The distance between the tip 51 of the second electrode member 50 and the tip 45 of the first electrode member 44 defines the arc gap. In practice, the arc gap distance ranges from greater than about 0.025 inches to less than about 0.075 inches.

According to the present invention, a sinusoidally varying current source 61 is connected to provide alternating current to the electrodes 44 and 50 of the lamp 10. The alternating current is typically at a frequency of sixty hertz. In practice, a ballast induction coil 63 is also provided. In the illustrated embodiment, the AC current from source 61 flows to the electrode member 44 via the ballast coil 63, struts 40, the U-shaped flange member 32, and the ring 38.

In operation of the lamp 10 of FIGS. 1 and 2, the cavity 20 is filled with pressurized inert gas, such as xenon. The lamp 10 is illuminated when the breakdown voltage is exceeded across the arc gap, thereby resulting in an illuminating flow of electrons between the first and second electrode members 44 and 50, respectively. The typical current flow across the arc gap ranges from about one to fifty amperes or higher. It should be appreciated that flow of electrons back and forth between the electrodes is not continuous, but depends upon various factors, including the breakdown potential across the arc gap. After the breakdown potential is exceeded, current will surge across the gap to provide luminescence. The frequency of the luminescent surges or bursts depends upon the frequency of the alternating current driving source. The light which emminates from the discharge across the arc gap is collimated by the reflector 11 and passes outward through the window 30.

In conventional short-arc lamps with internal reflectors and direct current drive, the tip of the cathode is positioned such that it is at the focal point of the internal reflector. The reason for such positioning in direct current driven lamps is that the tip of the cathode is the location of primary luminescence of such lamps, as a so-called hot spot is developed at the tip of the cathode. It is known, however, that the hot spot causes degredation of the tip of the cathode, an effect known as burnback, which significantly reduces the effectiveness of the lamp. In the lamp of the present invention, the midpoint of the arc gap can be located at the focal point of the lamp, and the alternating drive current produces less burnback and improved uniformity.

Although the present invention has been described in terms of the presently preferred embodiments, it is to be understood that such disclosure is not to be interpreted as limiting. Various alterations and modifications will no doubt become apparent to those skilled in the art after having read the above disclosure. Accordingly, it is intended that the appended claim be interpreted as covering all alterations and modifications as fall within the true spirit and scope of the invention.

We claim:

1. An improved alternating current lamp of the short-arc type comprising:

a body formed of a dielectric material;

a concave reflector fitted within the body to define a curved reflecting wall symmetrical about a central axis of the lamp;

a transparent window assembly sealing mounted to the body transverse to said central axis to maintain pressurized gas within the space encompassed by the curved reflector and to pass collimated light from the lamp;

first and second opposed electrodes mounted to extend along said central axis with the distal tip ends of said electrodes being spaced apart from one another in opposed relationship to define a short-arc gap with the midpoint of the short-arc gap located at the focal point of the concave reflector; and means connected to the respective electrodes to convey alternating current electric to the electrodes to provide an alternating luminscent flow of electrons across said short-arc gap between the tips of the first and second electrodes, such that deterioration of the electrodes is uniform and reduced with the midpoint of the short-arc gap remaining at the focal point of the concave reflector.

* * * * *